United States Patent [19]

Owens

[11] Patent Number: 5,012,937

[45] Date of Patent: May 7, 1991

[54] GREETING CARD DISPLAY RACK

[76] Inventor: Nancy L. Owens, 1758 Adams Cir. South, Largo, Fla. 34641

[21] Appl. No.: 382,983

[22] Filed: Jul. 21, 1989

[51] Int. Cl.[5] ..... A47F 7/00

[52] U.S. Cl. ..... 211/189; 40/124; 211/41; 211/194

[58] Field of Search ..... 211/40, 41, 189, 194; 40/124, 124.4

[56] References Cited

U.S. PATENT DOCUMENTS

| | | | |
|---|---|---|---|
| 253,461 | 2/1882 | Wold | 211/41 |
| 325,196 | 8/1885 | Caldwell | 211/41 X |
| 1,660,210 | 2/1928 | Schaefer | 211/41 |
| 4,657,146 | 4/1987 | Walters | 211/40 X |

*Primary Examiner*—Robert W. Gibson, Jr.

*Attorney, Agent, or Firm*—Frijouf, Rust & Pyle

[57] ABSTRACT

A central shaft supports sets of two laterally projecting parallel limbs. Preferably, four sets of limbs project in 90° relationship. Each limb is serrated to provide a plurality of correspondingly placed card holding notches.

Thus, greeting cards may be placed, one to a set of notches, and thereby removably hold in an upright position for viewing and/or removal and return.

In addition, the central shaft is provided in interlockable add-on sets, with similar branches as those of the set below. Thus the tree "grows" as more cards arrive, and by supplying each added shaft with shorter limbs than those below, a simulated tree configuration takes form.

2 Claims, 2 Drawing Sheets

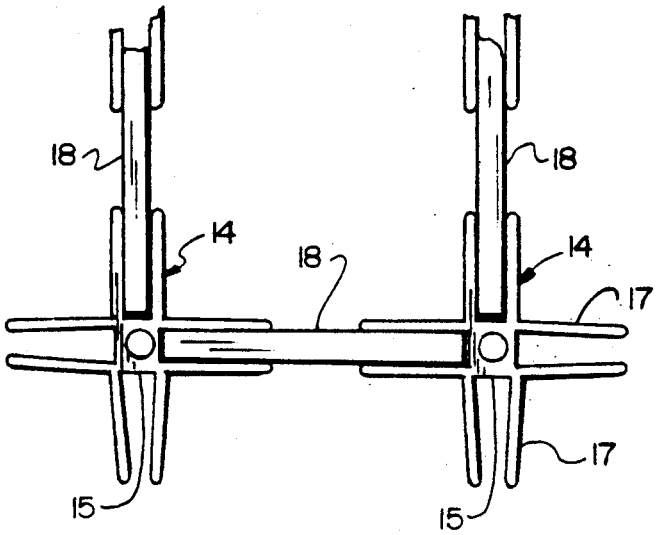
FIG. 3
FIG. 4
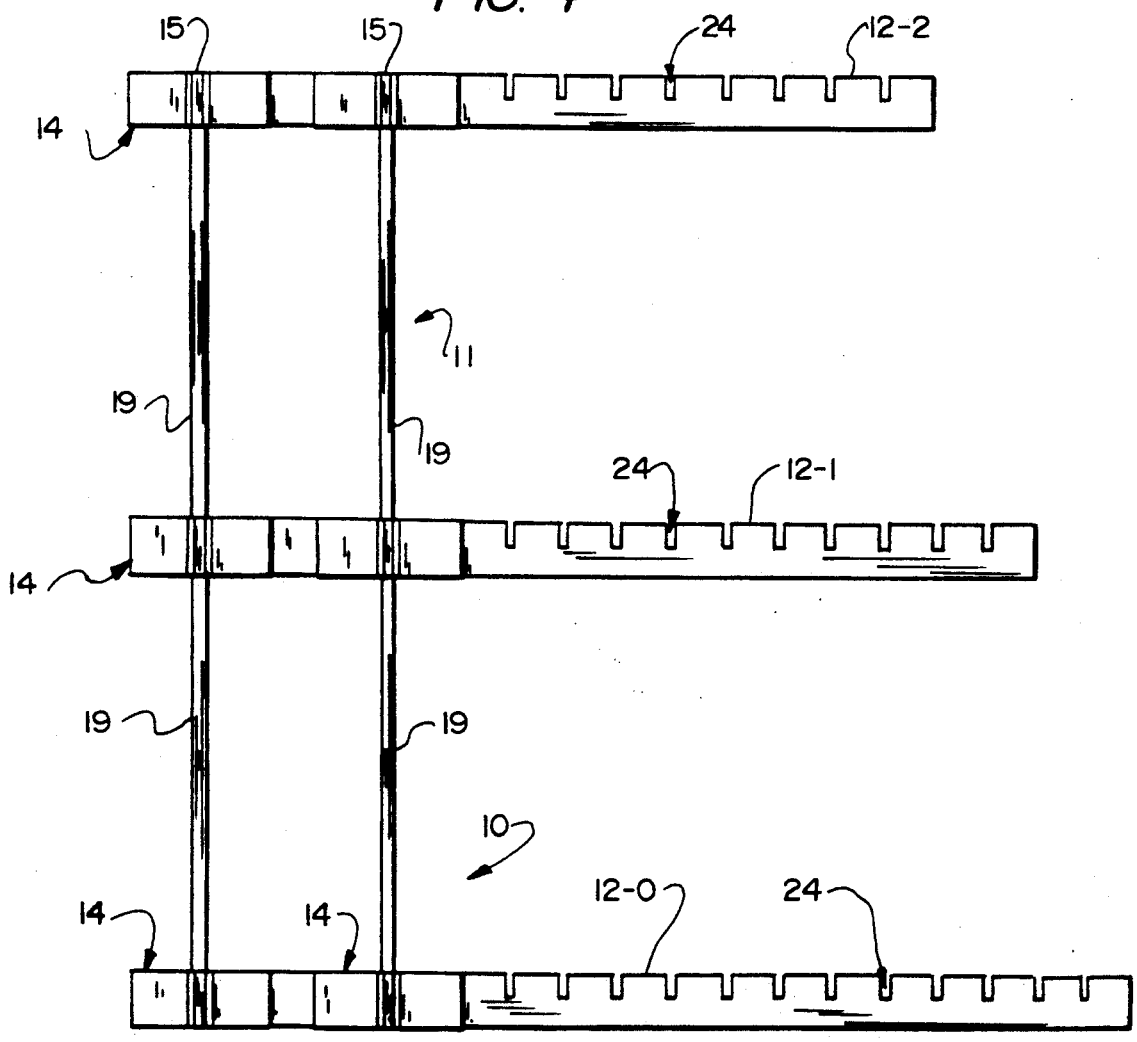

GREETING CARD DISPLAY RACK

BACKGROUND OF THE INVENTION

1. Field of the Invention

The field of the invention is display racks wherein merchandise is usually displayed on a counter. However, the primary purpose of this invention is home display of greeting cards.

2. Description of Prior Art

The greeting card industry is a year-round business, but there probably is no time of mass exchange of greeting cards equal to the Christmas season.

There are two means of dealing with arrival of large numbers of greeting cards. One is to simply collect them in a basket or similar container and the other is to tape or tack hold them as a garland around a door, fireplace, or mirror.

Neither of the usual card treatments is satisfactory. Those in a basket are usually ignored or given cursory examination, or at best picked up and shuffled through one-by-one. The garland approach is more colorful but often leaves tape marks on the wall, and some cards are out of reach or oriented with the personal message or signature to the wall.

It is an object of this invention to provide a rack which will display cards in a vertical array sloping from a wide array at the bottom to a narrow array at the top, much in tree fashion.

It is another object of the invention to provide such rack in multiple units which will allow the tree to grow larger as cards arrive.

It is a further object of the invention to provide a display rack wherein the greeting cards may be easily removed from the supporting branches of the tree and returned.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

A central shaft, of a single piece or as composite, is outfitted with horizontal sets or removably secured limbs. The limbs are serrated to form upwardly opening notches. The notches of a set are matched in distance from the shaft so that a greeting card seated in two corresponding notches is held in an upright display.

There are a plurality of like shafts, stackable, and outfitted with similar, but shorter branches, so that as cards are received, a second story tier is added. Three sets of shafts are the maximum for visually pleasing effect.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following datailed description taken in connection with the accompanying drawings in which:

FIG. 3 is a top view of a portion of one base, taken in the area of the line 3—3 of FIG. 1; and FIG. 4 is a side elevation of a composite of two central shafts, with only one quadrant of branches, to illustrate the possibility of multiple stories available as need arises.

Similar reference characters refer to similar parts throughout the several views of the drawings.

DETAILED DISCUSSION

Figure 1:
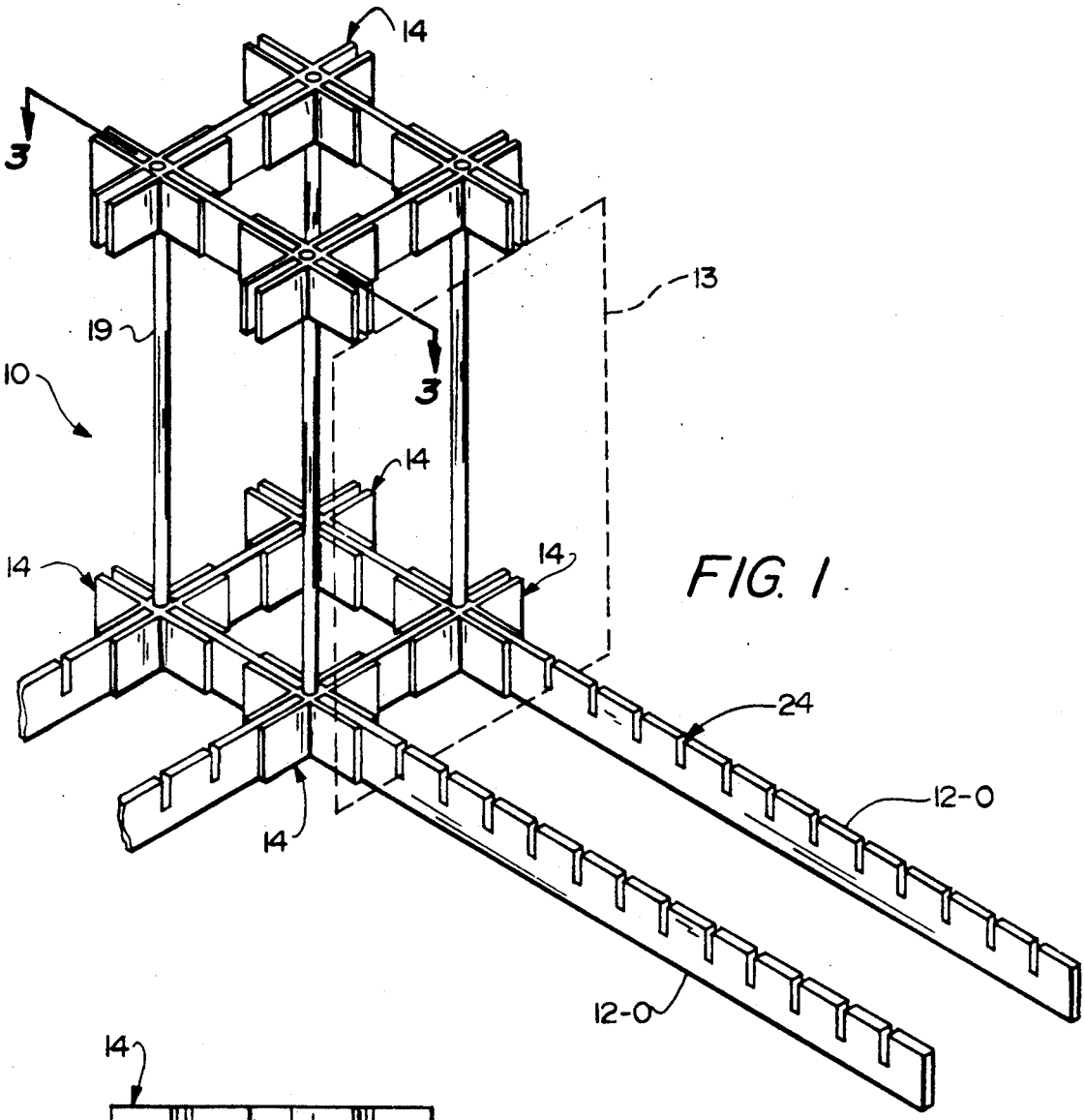
FIG. 1 is a perpective view of a base, or first section, with only one set of limbs installed, and a phantom greeting card in supported position.
Figure 2:
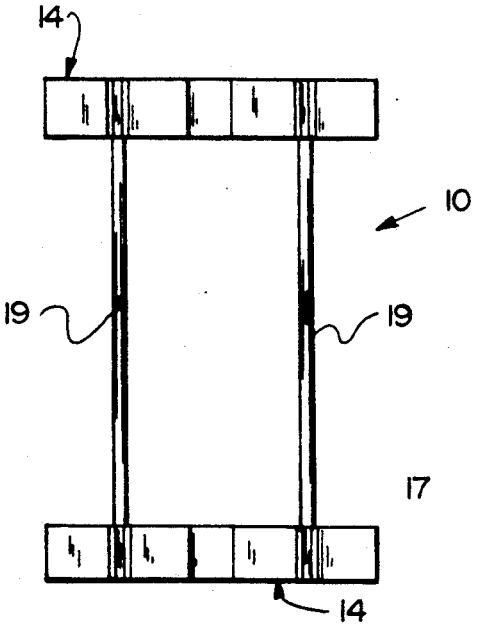
FIG. 2 is a side elevation of the central shaft of FIG. 1.

The preferred embodiment as built and tested is illustrated in the drawings. The material from which the preferred embodiment has been built is a clear, transparent resin material but may be readily constructed from metal or wood. The transparent resin material is a modern, light appearing material and is therefore preferred.

As illustrated, the preferred embodiment is composed of a central shaft 10 as a starter or base structure.

A secondary shaft 11 is capable of being interfitted to and mounted upon the base 10 as illustrated in FIG. 4.

In the preferred construction, cantilever beams 12 are extended from the central shaft in four quadrants. Each quadrant is composed of a pair of matching beams 12 for receiving and supporting a greeting card, as suggested by the phantom outline 13 in FIG. 1.

The base shaft 10 has top and bottom beam support constructions which are substantially identical. These base structures are formed by base pedestals 14 which together define a base plane for seating the central shaft on a table or other planar surface. As best seen in FIG. 3, each of the corner pedestals is formed of a central core 15 and four radiating jaws 16 spaced in 90° relationship to one another.

Each of the jaws 16 is formed by converging walls 17. See FIG. 3. The walls 17 are referred to in some instances as leaves of a pinch clamp.

Also, in FIG. 3, there is illustrated a coupler arm 18 which couples adjacent base pedestals. The coupler arms are rectangular strips of material of a length arbitrarily chosen to space the base pedestals at a convenient distance for likewise spacing the beams 12 at a distance which will provide support for most greeting cards.

The coupler arms 18 are held in the jaws 16 by frictionally gripping due to the converging nature of the leaves 17 as described. Thus, the central shaft may be dismantled for storing and reassembled by forcing the coupler arms 18 into corresponding sets of jaws 16 as illustrated in FIG. 3.

The cantilever beams 12 are then inserted into parallel sets of the jaws 16 as best seen in FIG. 1 and further illustrated in elevation in FIG. 4.

There is no need for physical locking devices to hold the coupler arms and the cantilever beams in the illustrated position because of the natural frictional holding due to the converging walls 17. The load to be supported is not great, and accordingly, the frictional grip has been found to be quite sufficient for holding the cards in removable display.

The central shaft 10 of the preferred embodiment is composed of the sets of corner pedestals 14 united by rods 19. The rods 19 fit into central openings in the central core 15 as seen best in FIG. 3. Thus, essentially similar modular units of four pedestals may be mounted one upon another as high as desired. It has been found aesthetically and practically, however, that three corners pedestal assemblies as shown as FIG. 4, supported by two sets of rods 19, is aesthetically as high as desirable. Any further need for supporting cards is best achieved by further units of the preferred card tree.

In order to simulate a tree configuration, and to produce an aesthetically desirable appearance, the sets of corner pedestals are equipped with branch limbs 20, 21 and 22 which are respectively the long, middle and short branches to produce a converging upwardly display configuration.

Each of the branches are notched or serrated to produce the notches 24 as best seen in FIG. 1. It is essential that two branches be provided in sets for proper support of a card. The notches are narrow, being about the ordinary thickness of a greeting card, and thus held simply by a very small portion of the edge of the card which is satisfactory for support and display.

It is the preferred embodiment to use transparent material and corner pedestal arrays of transparent, resinous material, supported by rods of similar material, but a central shaft of rectangular wooden rod or similar material, with branches held by projecting dowel pins will provide a suitable alternative. Furthermore, a second embodiment has been found to be an acceptable alternative. The second proposed alternative is to provide limbs or branches 20 in a downwardly directed angular position to more nearly suggest a Christmas tree as the cards are displayed. In such an array, the notches must be slanted in the branches in order to provide an upright support for the cards.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A greeting card display rack, simulating a tree configuration, comprising:

a central shaft having surfaces defining a base plane, said base plane seatable upon a planar support surface;

a base of four sets of two card support branches, said branches of each set arranged in parallel relationship to one another and in rectangular relationship to adjacent sets, each branch of each set of branches being duplicates with a like plurality of notches opening upwardly and in mutual alignment to receive and support a greeting card in upright display;

each branch of each set being removably attached and supported at one end thereof to said central shaft at the base, to establish a set of four card support sets around said central shaft;

a second array of four sets of two card support branches, said branches of each set arranged in parallel relationship to one another and in rectangular relationship to adjacent sets, each branch of each set of branches of said second array being duplicates with a like plurality of notches opening upwardly and in mutual alignment to receive and support a greeting card in upright display;

each branch of each set in said second array being removably attached and supported at one end thereof to said central shaft;

said second array being above the base plane and each branch of said second array being shorter than the branches of the set below;

whereby, the second array may be added as the numbers of greeting cards on display in the base four sets fill the available support.

2. A holding rack for greeting card display, comprising:

four corner key members, each key member having a central core and four sets of spring leaves projecting in perpendicular array from said core, said leaves being converging non-parallel and extending from the core to provide a clamp action upon an object wedge therein;

means joining said four key members into a rectangular array with two sets of said leaves on each key member projecting from the rectangular array;

two sets of leaves in each key member lying parallel and spaced from a like set of leaves of an adjacent key member;

eight cantilever beams each having a like plurality of notches, said beams having a thickness dimension substantially equal to the separation distance of said leaves at the attachment thereof to said core area;

whereby, wedging of a beam into each set of leaves will removably secure the beams and present sets of aligned upwardly opening notches for holding a plurality of greeting cards upright for display.

* * * * *